US008475146B2

(12) United States Patent
Liu

(10) Patent No.: US 8,475,146 B2
(45) Date of Patent: Jul. 2, 2013

(54) BLOWER ADAPTER AND BLOWER USING THE SAME

(75) Inventor: Xiang Liu, Zhongshan (CN)

(73) Assignee: Zhongshan Broad-Ocean Motor Co., Ltd., Zhongshan (CN)

( * ) Notice: Subject to any disclaimer, the term of this patent is extended or adjusted under 35 U.S.C. 154(b) by 375 days.

(21) Appl. No.: 12/726,529

(22) Filed: Mar. 18, 2010

(65) Prior Publication Data

US 2011/0008196 A1 Jan. 13, 2011

(30) Foreign Application Priority Data

Jul. 8, 2009 (CN) ..... 2009 2 0060396 U

(51) Int. Cl.
*F04D 29/42* (2006.01)
*F04D 25/06* (2006.01)
*F16L 55/00* (2006.01)

(52) U.S. Cl.
USPC ..... 417/423.14; 417/423.1; 415/206

(58) Field of Classification Search
USPC ..... 415/206, 211.2; 417/423.1, 423.14
See application file for complete search history.

(56) References Cited

U.S. PATENT DOCUMENTS

| | | | | |
|---|---|---|---|---|
| 6,314,894 | B1 * | 11/2001 | Gatley, Jr. | 110/341 |
| 6,848,681 | B2 * | 2/2005 | Washington et al. | 261/76 |
| 6,902,373 | B1 * | 6/2005 | Glanton | 415/207 |
| 7,018,169 | B2 * | 3/2006 | Phillip et al. | 415/60 |
| 2003/0228216 | A1 * | 12/2003 | Metz | 415/206 |
| 2004/0022627 | A1 * | 2/2004 | Hanchett | 415/211.2 |
| 2009/0274551 | A1 * | 11/2009 | Messmer | 415/148 |
| 2011/0008152 | A1 * | 1/2011 | Liu | 415/121.3 |

* cited by examiner

*Primary Examiner* — Peter J Bertheaud
*Assistant Examiner* — Dominick L Plakkoottam
(74) *Attorney, Agent, or Firm* — Matthias Scholl P.C.; Matthias Scholl

(57) ABSTRACT

An adapter, containing at least an inlet portion, an outlet portion, and a transition portion. The inlet portion, the outlet portion and the transition portion are integrally formed, and the transition portion bends upwards whereby staggering the inlet portion and the outlet portion. The adapter is easy to assemble and disassemble, which makes it easy to connect the blower to an external equipment. Moreover, the adapter is integrally formed, features simple structure and is convenient to cast, all of which reduces time for production and mold opening, and thus decreases production cost.

14 Claims, 6 Drawing Sheets

BLOWER ADAPTER AND BLOWER USING THE SAME

CROSS-REFERENCE TO RELATED APPLICATIONS

Pursuant to 35 U.S.C. §119 and the Paris Convention Treaty, this application claims the benefit of Chinese Patent Application No. 200920060396.3 filed on Jul. 8, 2009, the contents of which are incorporated herein by reference.

BACKGROUND OF THE INVENTION

1. Field of the Invention

The invention relates to an adapter and a blower using the same.

2. Description of the Related Art

Blowers are widely used in industries nowadays, and adapters are used for connecting air outlets of the blowers to external pipes with different shapes. However, there are several non-neglectable problems with the conventional adapters: firstly, the adapters are difficult to be assembled and disassembled; secondly, structure of the adapters is complex, and production and mould opening of the adapters are time-consuming, which increase production cost.

SUMMARY OF THE INVENTION

In view of the above-described problem, it is one objective of the invention to provide an adapter that is easy to be assembled and disassembled, and features simple structure, reduced time for production and mould opening, and thus decreased production cost.

It is another objective of the invention to provide a blower comprising an adapter that is easy to be assembled and disassembled, and features simple structure, reduced time for production and mould opening, and thus decreased production cost.

To achieve the above objectives, in accordance with one embodiment of the invention, provided is an adapter, comprising an inlet portion, an outlet portion, and a transition portion. The inlet portion, the outlet portion and the transition portion are integrally formed, and the transition portion bends upwards whereby staggering the inlet portion and the outlet portion.

In a class of this embodiment, the inlet portion is rectangular, and the outlet portion is circular.

In a class of this embodiment, the adapter is integrally formed via aluminum or aluminum alloy.

In a class of this embodiment, the inlet portion comprises a bottom surface, and three side walls.

In a class of this embodiment, a protruding plate extends from the bottom surface.

In a class of this embodiment, a gap is disposed between the protruding plate and each of two opposite ones of the side walls.

In a class of this embodiment, multiple through holes are disposed on each of the side walls.

In a class of this embodiment, an angle $\alpha$ between the bottom surface and the bottom of the outlet portion ranges from 18 to 25°.

In a class of this embodiment, a length L of the adapter ranges from 55 to 65 mm, a length L1 of the inlet portion ranges from 10 to 17 mm, a width W of the adapter ranges from 65 to 80 mm, a height H of the adapter ranges from 40 to 50 mm, a length L2 of the outlet portion ranges from 12 to 18 mm, and a diameter D of the outlet portion ranges from 90 to 120 mm.

In a class of this embodiment, an angle $\beta$ between a top surface of the inlet portion and the top of the outlet portion ranges from 50 to 75°.

In accordance with one embodiment of the invention, provided is a blower, comprising a motor having a rotating shaft, an impeller, a housing, an air inlet, an air outlet, a cavity, and an adapter, comprising an inlet portion, an outlet portion, and a transition portion. The motor is disposed on the housing, the air inlet is disposed at the bottom of the housing, the air outlet is disposed on one side of the housing, the cavity is formed in the housing, the impeller is disposed in the cavity, and on the rotating shaft of the motor, the adapter is fit on the air outlet, the inlet portion, the outlet portion and the transition portion are integrally formed, and the transition portion bends upwards whereby staggering the inlet portion and the outlet portion.

In a class of this embodiment, the inlet portion is rectangular, and the outlet portion is circular.

In a class of this embodiment, the adapter is integrally formed via aluminum or aluminum alloy.

In a class of this embodiment, the inlet portion comprises a bottom surface, and three side walls, a protruding plate extends from the bottom surface, and a gap is disposed between the protruding plate and each of two opposite ones of the side walls.

In a class of this embodiment, the air outlet comprises a bottom surface and three side walls, the protruding plate is received in the bottom surface of the air outlet, the bottom surface of the inlet portion is disposed in the bottom surface of the air outlet, and the side walls of the air outlet are received in the gap of the inlet portion.

In a class of this embodiment, multiple through holes are disposed on each of the side walls, multiple screw holes corresponding to the through hole are disposed on each side wall of the air outlet, a screw passes through the through hole and is received in the screw hole whereby fixing the adapter.

In a class of this embodiment, an angle $\alpha$ between the bottom surface and the bottom of the outlet portion ranges from 18 to 25°.

In a class of this embodiment, a length L of the adapter ranges from 55 to 65 mm, a length L1 of the inlet portion ranges from 10 to 17 mm, a width W of the adapter ranges from 65 to 80 mm, a height H of the adapter ranges from 40 to 50 mm, a length L2 of the outlet portion ranges from 12 to 18 mm, and a diameter D of the outlet portion ranges from 90 to 120 mm.

In a class of this embodiment, an angle $\beta$ between a top surface of the inlet portion and the top of the outlet portion ranges from 50 to 75°.

Advantages of the invention comprise: 1) the adapter is easy to be assembled and disassembled, which makes it easy to connect the blower to an external equipment; 2) the adapter is integrally formed via metal materials, and features simple structure and convenient casting, reduced time for production and mould opening, and thus decreased production cost; 3) the protruding plate is received in the bottom surface of the air outlet, and the side walls of the air outlet are received in the gap of the inlet portion, which causes the bottom surface of the inlet portion is aligned with that of the air outlet, and ensures stable structure; 4) dimension tolerance of the adapter is good enough, and wind resistance thereof is small, which ensure fluent exhaustion of air.

BRIEF DESCRIPTION OF THE DRAWINGS

Detailed description will be given below in conjunction with accompanying drawings, in which.

DETAILED DESCRIPTION OF THE EMBODIMENTS

Figure 1:
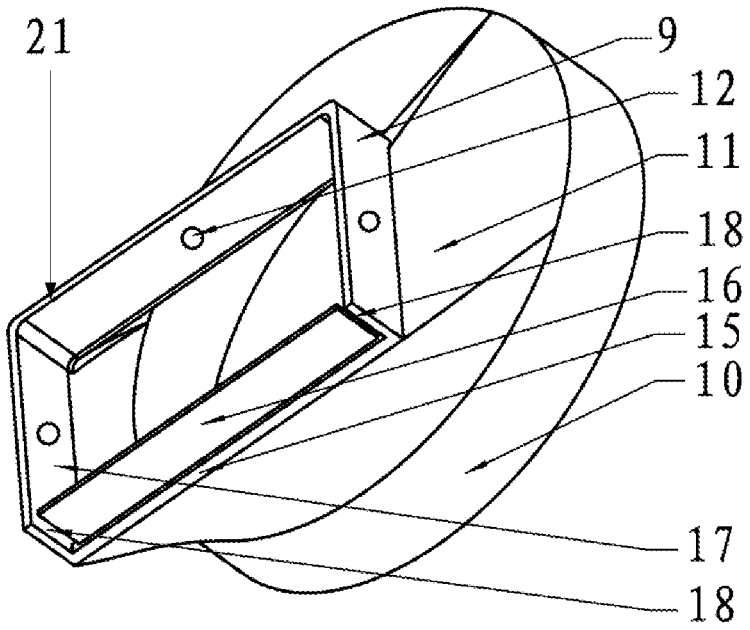
FIG. 1 is a schematic view of an adapter of an embodiment of the invention.
Figure 2:
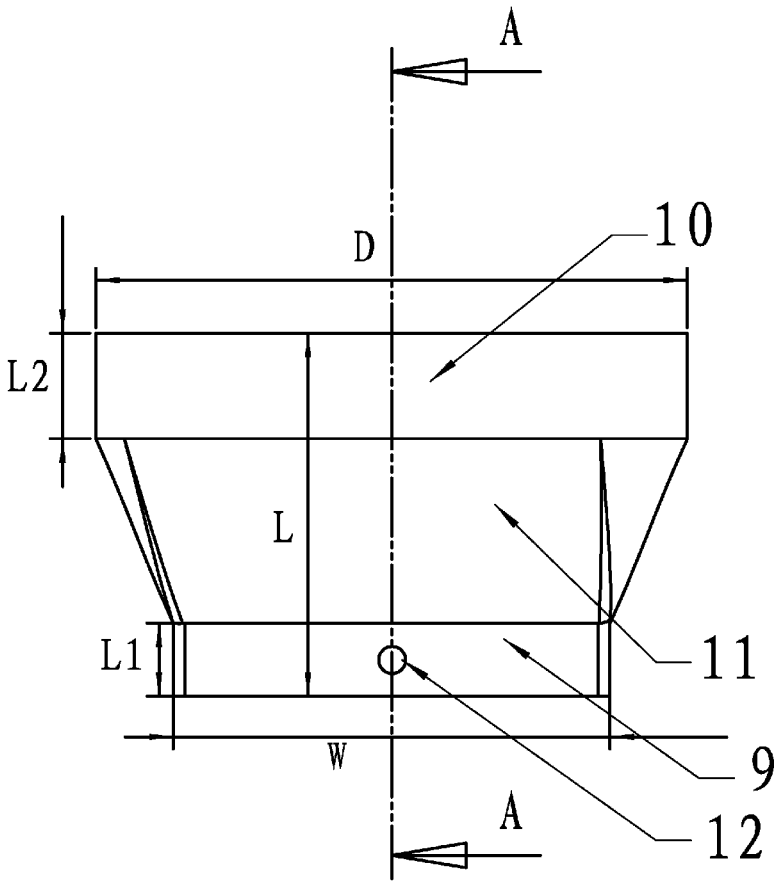
FIG. 2 is a plan view of an adapter in FIG. 1.
Figure 3:
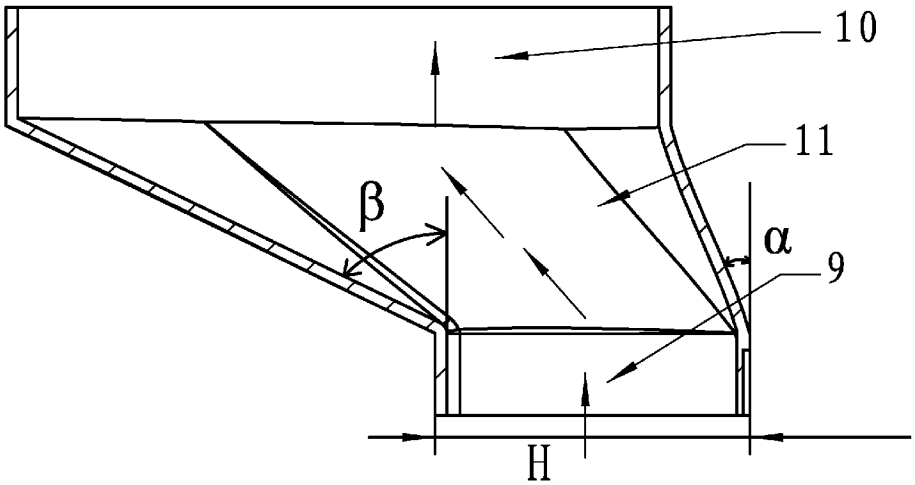
FIG. 3 is a cross-sectional view of an adapter in FIG. 1 along an A-A line.

As shown in FIGS. 1-3, an adapter of the invention comprises an inlet portion 9, an outlet portion 10, and a transition portion 11.

The inlet portion 9, the outlet portion 10 and the transition portion 11 are integrally formed, and the transition portion 11 bends upwards whereby staggering the inlet portion 9 and the outlet portion 10.

In this embodiment, the inlet portion 9 is rectangular, the outlet portion 10 is circular, and the adapter is integrally formed via aluminum or aluminum alloy.

The inlet portion 9 comprises a bottom surface 15, and three side walls 17.

A protruding plate 16 extends from the bottom surface 15 of the inlet portion 9.

Multiple through holes 12 are disposed on each of the side walls 17.

A gap 18 is disposed between the protruding plate 16 and each of two opposite ones of the side walls 17.

Airflow enters the inlet portion 9, and is discharged from the outlet portion 10 via the transition portion 11.

A length L of the adapter ranges from 55 to 65 mm, a length L1 of the inlet portion 9 ranges from 10 to 17 mm, a width W of the adapter ranges from 65 to 80 mm, a height H of the adapter ranges from 40 to 50 mm, a length L2 of the outlet portion 10 ranges from 12 to 18 mm, and a diameter D of the outlet portion 10 ranges from 90 to 120 mm.

An angle $\alpha$ between the bottom surface 15 and the bottom of the outlet portion 10 ranges from 18 to 25°, and an angle $\beta$ between a top surface 21 of the inlet portion 9 and the top of the outlet portion 10 ranges from 50 to 75°.

Figure 4:
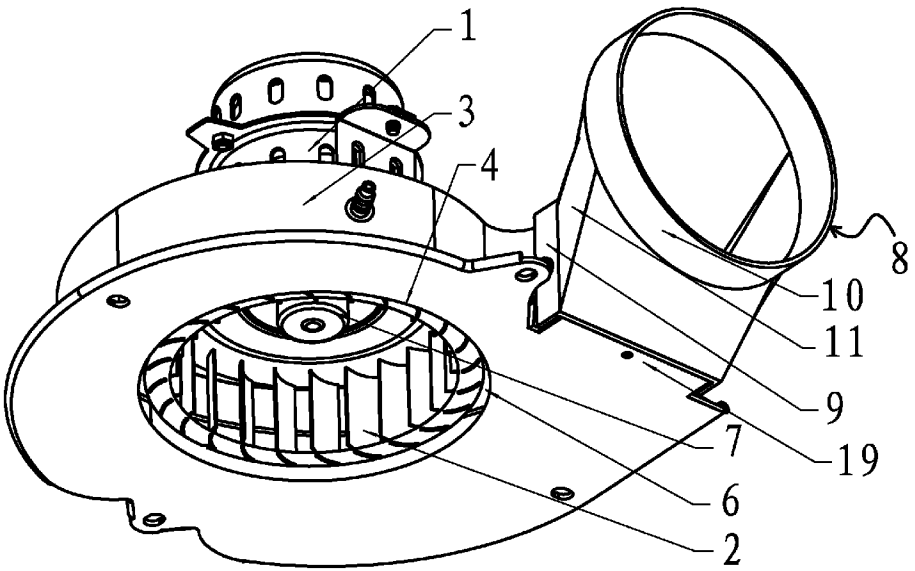
FIG. 4 is a schematic view of a blower of an embodiment of the invention.
Figure 5:
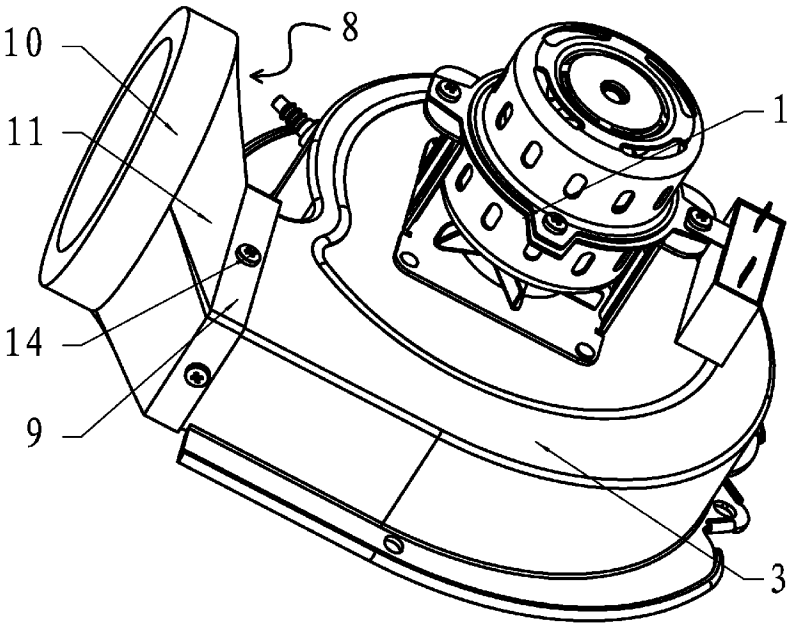
FIG. 5 is a schematic view of a blower in FIG. 4 in another direction.
Figure 6:
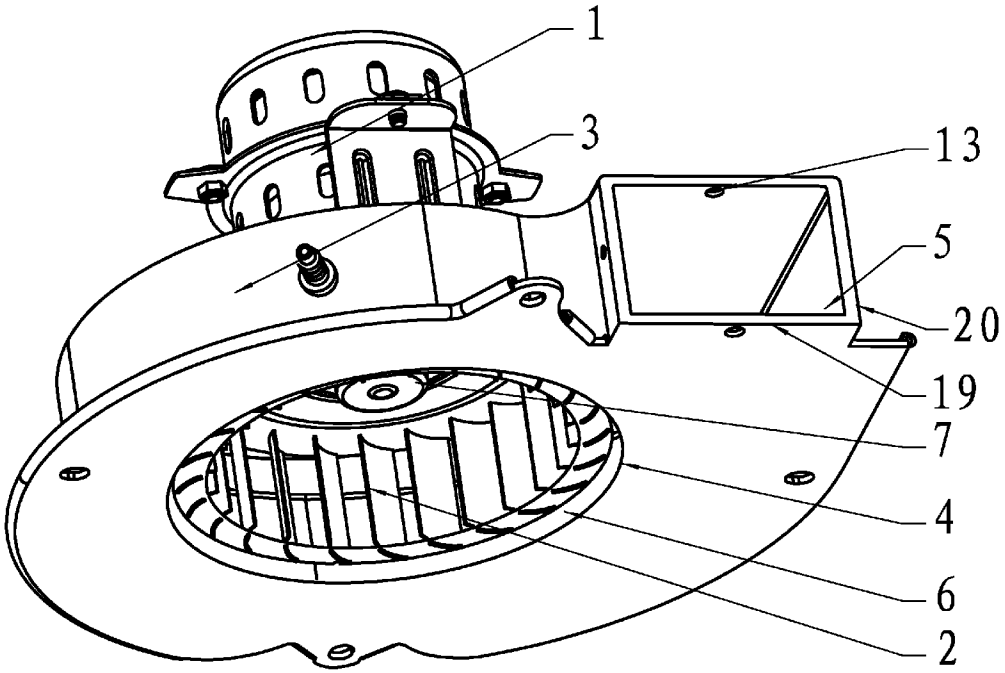
FIG. 6 is a schematic view of a blower without an adapter.

As shown in FIGS. 4-6, a blower of the invention comprises a motor 1 having a rotating shaft 7, an impeller 2, a housing 3, an air inlet 4, an air outlet 5, a cavity 6, and an adapter 8. The adapter 8 is fit on the air outlet 5, and comprises an inlet portion 9, an outlet portion 10, and a transition portion 11.

The motor 1 is disposed on the housing 3.

The air inlet 4 is disposed at the bottom of the housing 3.

The air outlet 5 is disposed on one side of the housing 3.

The cavity 6 is formed in the housing 3.

The impeller 2 is disposed in the cavity 6, and on the rotating shaft 7 of the motor 1.

The inlet portion 9, the outlet portion 10 and the transition portion 11 are integrally formed, and the transition portion 11 bends upwards whereby staggering the inlet portion 9 and the outlet portion 10.

In this embodiment, the inlet portion 9 is rectangular, the outlet portion 10 is circular, and the adapter 8 is integrally formed via aluminum or aluminum alloy.

The inlet portion 9 comprises a bottom surface 15, and three side walls 17.

A protruding plate 16 extends from the bottom surface 15, and a gap 18 is disposed between the protruding plate 16 and each of two opposite ones of the side walls 17.

The air outlet 5 comprises a bottom surface 19 and three side walls 20.

The protruding plate 16 is received in the bottom surface 19 of the air outlet 5, The bottom surface 15 of the inlet portion 9 is disposed in the bottom surface 19 of the air outlet 5.

The side walls 20 of the air outlet 5 are received in the gap 18 of the inlet portion 9.

Multiple through holes 12 are disposed on each of the side walls 17,

Multiple screw holes 13 corresponding to the through hole 12 are disposed on each side wall 20 of the air outlet 5, A screw 14 passes through the through hole 12 and is received in the screw hole 13 whereby fixing the adapter 8.

Airflow enters the inlet portion 9 via the air outlet 5, and is discharged from the outlet portion 10 via the transition portion 11.

A length L of the adapter 8 ranges from 55 to 65 mm, a length L1 of the inlet portion 9 ranges from 10 to 17 mm, a width W of the adapter 8 ranges from 65 to 80 mm, a height H of the adapter 8 ranges from 40 to 50 mm, a length L2 of the outlet portion 10 ranges from 12 to 18 mm, and a diameter D of the outlet portion 10 ranges from 90 to 120 mm.

An angle $\alpha$ between the bottom surface 15 and the bottom of the outlet portion 10 ranges from 18 to 25°, and an angle $\beta$ between the top surface 21 of the inlet portion 9 and the top of the outlet portion 10 ranges from 50 to 75°.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An adapter for a blower, the blower comprising an air outlet (5), the air outlet (5) comprising a bottom surface (19) and three side walls (20), the adapter comprising:

an inlet portion (9), said inlet portion (9) comprising a bottom surface (15) and three side walls (17), said three side walls (17) of said inlet portion (9) jointly comprising a top surface (21);

a protruding plate (16);

an outlet portion (10); and a transition portion (11);

wherein:

said protruding plate (16) is fixed on said bottom surface (15) of said inlet portion (9) and adjacent to two of said three side walls (17) of said inlet portion (9) that are opposite to each other;

a third of said three side walls (17) of said inlet portion (9) is opposite to said protruding plate (16) and is adjacent to said two of said three side walls (17) of said inlet portion (9);

two gaps (18) are formed respectively between said protruding plate (16) and said two of said three side walls (17) of said inlet portion (9);

said protruding plate (16) is adapted to be received in the bottom surface (19) of the air outlet (5);

said two gaps (18) are adapted to receive the three side walls (20) of the air outlet (5);

said inlet portion (9), said outlet portion (10), and said transition portion (11) are integrally formed; and said transition portion (11) bends upwards whereby staggering said inlet portion (9) and said outlet portion (10).

2. The adapter of claim 1, wherein
said inlet portion (9) is rectangular; and
said outlet portion (10) is circular.

3. The adapter of claim 1, wherein said adapter is integrally formed via aluminum or aluminum alloy.

4. The adapter of claim 1, wherein multiple through holes (12) are disposed on each of said three side walls (17) of said inlet portion (9).

5. The adapter of claim 1, wherein an angle α between said bottom surface (15) of said inlet portion (9) and the bottom of said outlet portion (10) ranges from 18 to 25°.

6. The adapter of claim 1, wherein
a length L of said adapter ranges from 55 to 65 mm;
a length L1 of said inlet portion (9) ranges from 10 to 17 mm;
a width W of said adapter ranges from 65 to 80 mm;
a height H of said adapter ranges from 40 to 50 mm;
a length L2 of said outlet portion (10) ranges from 12 to 18 mm; and
a diameter D of said outlet portion (10) ranges from 90 to 120 mm.

7. The adapter of claim 1, wherein an angle β between said top surface (21) and the top of said outlet portion (10) ranges from 50 to 75°.

8. A blower, comprising
a motor (1) having a rotating shaft (7);
an impeller (2);
a housing (3);
an air inlet (4);
an air outlet (5);
a cavity (6); and
an adapter (8), said adapter (8) comprising:
an inlet portion (9), said inlet portion (9) comprising a first bottom surface (15) and three first side walls (17), said three first side walls (17) jointly comprising a top surface (21);
a protruding plate (16);
an outlet portion (10); and
a transition portion (11);
wherein:
said motor (1) is disposed on said housing (3);
said air inlet (4) is disposed at the bottom of said housing (3);
said air outlet (5) is disposed on one side of said housing (3);
said cavity (6) is formed in said housing (3);
said impeller (2) is disposed in said cavity (6), and on said rotating shaft (7);
said adapter (8) is fit on said air outlet (5);
said protruding plate (16) is fixed on said first bottom surface (15) and adjacent to two of said three first side walls (17) that are opposite to each other;
two gaps (18) are formed respectively between said protruding plate (16) and two of said three first side walls (17) that are adjacent to said protruding plate (16);
said air outlet (5) comprises a second bottom surface (19) and three second side walls (20);
said protruding plate (16) is received in said second bottom surface (19);
said first bottom surface (15) is disposed in said second bottom surface (19);
said three second side walls (20) are received in said two gaps (18);
said inlet portion (9), said outlet portion (10), and said transition portion (11) are integrally formed; and
said transition portion (11) bends upwards whereby staggering said inlet portion (9) and said outlet portion (10).

9. The blower of claim 8, wherein
said inlet portion (9) is rectangular; and
said outlet portion (10) is circular.

10. The blower of claim 8, wherein said adapter (8) is integrally formed via aluminum or aluminum alloy.

11. The blower of claim 8, wherein
multiple through holes (12) are disposed on each of said first side walls (17);
multiple screw holes (13) corresponding to said through hole (12) are disposed on each of said three second side walls (20);
a screw (14) passes through said through hole (12) and is received in said screw hole (13) whereby fixing said adapter (8).

12. The blower of claim 8, wherein an angle α between said first bottom surface (15) and the bottom of said outlet portion (10) ranges from 18 to 25°.

13. The blower of claim 8, wherein
a length L of said adapter (8) ranges from 55 to 65 mm;
a length L1 of said inlet portion (9) ranges from 10 to 17 mm;
a width W of said adapter (8) ranges from 65 to 80 mm;
a height H of said adapter (8) ranges from 40 to 50 mm;
a length L2 of said outlet portion (10) ranges from 12 to 18 mm; and
a diameter D of said outlet portion (10) ranges from 90 to 120 mm
multiple through holes (12) are disposed on each of said three first side walls (17);
multiple screw holes (13) corresponding to said through hole (12) are disposed on each of said three second side walls (20);
a screw (14) passes through said through hole (12) and is received in said screw hole (13) whereby fixing said adapter (8).

14. The blower of claim 8, wherein an angle β between said top surface (21) and the top of said outlet portion (10) ranges from 50 to 75°.

* * * * *